US008567220B1

(12) United States Patent
Mchatet

(10) Patent No.: US 8,567,220 B1
(45) Date of Patent: Oct. 29, 2013

(54) MAGNETIC LOCK ASSEMBLY

(71) Applicant: Hamid Mchatet, Miami, FL (US)

(72) Inventor: Hamid Mchatet, Miami, FL (US)

( * ) Notice: Subject to any disclaimer, the term of this patent is extended or adjusted under 35 U.S.C. 154(b) by 0 days.

(21) Appl. No.: 13/777,362

(22) Filed: Feb. 26, 2013

(51) Int. Cl.
*E05B 73/00* (2006.01)

(52) U.S. Cl.
USPC ..... 70/14; 70/57.1; 70/58; 211/4

(58) Field of Classification Search
USPC ..... 70/14, 57.1, 58; 211/4
See application file for complete search history.

(56) References Cited

U.S. PATENT DOCUMENTS

| | | | | |
|---|---|---|---|---|
| 5,077,872 | A * | 1/1992 | Guthammar | 24/704.1 |
| 5,275,027 | A | 1/1994 | Eklof et al. | |
| 5,372,020 | A * | 12/1994 | Stoltz et al. | 70/57.1 |
| 5,509,528 | A * | 4/1996 | Weisburn | 206/45.24 |
| 5,600,977 | A * | 2/1997 | Piron | 70/57.1 |
| 5,624,040 | A | 4/1997 | Hono | |
| 5,711,432 | A | 1/1998 | Stein et al. | |
| 5,996,817 | A | 12/1999 | Kao | |
| 6,076,669 | A | 6/2000 | Ling | |
| 6,837,373 | B2 | 1/2005 | Huang | |
| 6,854,594 | B2 | 2/2005 | Vasudeva et al. | |
| 6,957,555 | B1 | 10/2005 | Nagel et al. | |
| 6,966,438 | B2 * | 11/2005 | Belden et al. | 206/308.1 |
| 7,137,513 | B2 * | 11/2006 | Sedon et al. | 211/59.1 |
| 7,259,674 | B2 * | 8/2007 | Marsilio et al. | 340/572.1 |
| 7,269,983 | B1 | 9/2007 | Mchatet et al. | |
| 7,281,397 | B2 * | 10/2007 | Victor | 70/58 |
| 7,350,645 | B1 | 4/2008 | Sills | |
| 7,441,424 | B2 * | 10/2008 | Saitoh et al. | 70/19 |
| 7,624,871 | B2 | 12/2009 | Sills | |
| 8,117,874 | B2 * | 2/2012 | McKeown | 70/57.1 |
| 8,223,022 | B2 * | 7/2012 | Skjellerup et al. | 340/572.1 |
| 8,307,995 | B2 * | 11/2012 | Surma et al. | 211/7 |
| 8,341,987 | B2 * | 1/2013 | Nagelski | 70/276 |
| 8,347,664 | B2 * | 1/2013 | Bishir et al. | 70/58 |
| 8,376,150 | B2 * | 2/2013 | Surma et al. | 211/7 |
| 2005/0230587 | A1 | 10/2005 | Yang | |

* cited by examiner

*Primary Examiner* — Suzanne Barrett
(74) *Attorney, Agent, or Firm* — Albert Bordas, P.A.

(57) ABSTRACT

A magnetic lock assembly, having a lock assembly; a key assembly; and packaging having at least one wall. The lock assembly mounts exteriorly onto the packaging. A rail assembly has rail members and a transversal member. A plate assembly mounts interiorly within the packaging. The lock assembly has a pin assembly. The lock assembly suspended from the rail members is placed in a locked position, whereby the pin assembly is blocked by the transversal member to prevent removal of the packaging from the rail assembly. The key assembly having a predetermined magnetic force is presented onto the lock assembly to cause the pin assembly to shift from the locked position, to an unlocked position, whereby the transversal member does not block the pin assembly to permit removal of the packaging from the rail assembly.

19 Claims, 4 Drawing Sheets

MAGNETIC LOCK ASSEMBLY

BACKGROUND OF THE INVENTION

1. Field of the Invention

The present invention relates to lock assemblies, and more particularly, to lock assemblies for retail packaging.

2. Description of the Related Art

Applicant believes that one of the closest references corresponds to Applicant's own U.S. Pat. No. 7,269,983 issued on Sep. 18, 2007 for a lock assembly. However, it differs from the present invention because Applicant then taught a lock assembly including a lock, a key and a rail assembly. The lock includes a lock housing and an actuating housing. The lock housing includes a rear notch, an internal notch that houses a spring and a locking tab, and an aperture that houses a second spring. A vertical track member is mounted to the rear notch and it has a vertical cutout. The actuating housing includes rear, lateral and top walls and a protrusion with a notch. The actuating housing is slidably mounted to the lock housing with a pin. The rail assembly is mounted to racks in stores wherein products for display are mounted thereto. The lock mounts onto the rail assembly by inserting the transversal member of the rail behind the protrusion and pressing the actuating housing against the lock housing until the locking tab engage into the notch.

Applicant believes that another reference corresponds to U.S. Patent Application Publication No. 20050230587 A1, published on Oct. 20, 2005 to Yang for a display device for article for sale. However, it differs from the present invention because Yang teaches a display device includes a plug device having a housing engageable into a hole of an article for sales, the housing includes a chamber and a spring blade having a projection to engage into a depression of the article, and for detachably attaching the housing to the article. A hanger device includes an actuator engageable into the chamber of the housing, to selectively engage with the spring blade of the housing, and to force and retain the projection of the spring blade within the depression of the article, and thus to detachably lock the housing to the article with the actuator of the hanger device. A locking device may be used to lock the actuator of the hanger device to the housing of the plug device.

Applicant believes that another reference corresponds to U.S. Pat. No. 7,624,871 B2 issued to Sills on Dec. 1, 2009 for a product security system for hanging merchandise. However, it differs from the present invention because Sills teaches a security system for preventing theft of hanging merchandise. The present invention includes a security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,350,645 B1 issued to Sills on Apr. 1, 2008 for a product security system for hanging merchandise. However, it differs from the present invention because Sills teaches a security system for preventing theft of hanging merchandise. The present invention includes a security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,137,513 B2, published on Nov. 21, 2006 to Sedon, et al. for a merchandise display system. However, it differs from the present invention because Sedon, et al. teaches a merchandise display system includes a rod lockably connected to a peg board, a hanging member hanging from the rod and a swivel member rotatably connected to the hanging member about a first axis. The swivel member is connected to a lockable display case for carrying an item of merchandise and is rotatable about a second axis perpendicular to the first axis. Thus, the display case is rotatable about the first and second axes to facilitate viewing the merchandise from any angle while the case is lockably connected to the rod. The hanging and swivel members may be a ball and socket combination. Alternately, the swivel member may connect to the display case via a hinge pin about which portions of the case may rotate to open and close. Alternately, a lower member may extend from within the case through holes therein to rotatably connect to the swivel member about the second axis.

Applicant believes that another reference corresponds to U.S. Pat. No. 6,957,555 B1 issued to Nagel, et al. on Oct. 25, 2005 for a locking attachment for product display hooks. However, it differs from the present invention because Nagel, et al. teaches a merchandise locking device for retrofit attachment to a product display hook installed on a merchandise display panel. The locking device attaches without tools to the upper wire arm of the display hook for pivoting movement between "lock" and "open" positions. A laterally opening recess in the locking device receives the lower arm of the display hook and a locking arm, rotatably mounted in the body of the locking device by a rotor element, closes the recess to lock the device to the lower arm and prevent the removal of merchandise therefrom. A simple key carried by store personnel enables the rotor to be released to free the locking device from the lower arm and permit the removal of merchandise. The locking device consists of four elements, including the key, and can be manufactured at very low cost, suitable for mass merchandise applications. Simple changes in rotor components enable the locking device to be operated by different keys, which may be color coded with the locking devices or components thereof. A bracket is also provided for retrofit attachment to the display hook, to prevent bodily removal of the hook and its contents from the display panel.

Applicant believes that another reference corresponds to U.S. Pat. No. 6,854,594 B2 issued to Vasudeva, et al. on Feb. 15, 2005 for a product holder with point-of-sale security. However, it differs from the present invention because Vasudeva, et al. teaches a point-of-sale security system is provided herein. The security system includes a container for containing the product and a holder assembly, the holder assembly including a closure device for closing the container. The holder assembly and the container are operatively coupled together by means of cooperative members. The cooperative members being configured in a special way, i.e., when an associated stop member is enabled, the cooperative members prevent decoupling of the holder assembly from the container, and when the stop member is disabled, the cooperative members enable decoupling of the holder assembly from the container.

Applicant believes that another reference corresponds to U.S. Pat. No. 6,837,373 B2 issued to Huang on Jan. 4, 2005 for a tool suspension device with a burglarproof feature. However, it differs from the present invention because Huang teaches a tool suspension device for pliers has a suspension board and a bracket. The suspension board has a front, a rear, a clip and a removable locking stub. The clip is mounted on the rear of the suspension board. The removable locking stub is attached to the front of the suspension board. The bracket is mounted on the front of the suspension board and has a U-shaped frame and clamping arms inside the frame. A tool slot is defined vertically through the frame and is adapted to hold a tool that is positioned head down. The removable locking stub prevents upward movement of the tool to prevent the tool from being easily pulled out of the tool slot to steal. The clip is used to hang the tool suspension device on a person's belt. Therefore, the tool suspension device is burglarproof and double-duty.

Applicant believes that another reference corresponds to U.S. Pat. No. 6,076,669 B1 issued to Ling on Jun. 20, 2000 for a tool display rack. However, it differs from the present invention because Ling teaches a tool display rack includes a body with a first engaging member extending from the first end thereof in which a first aperture is defined, a limiting member connected to the body at its first end by a connecting plate and having a recess defined therein, a second engaging member extending from the second end of the limiting member so as to engage with the first aperture, a second aperture defined in the second end of the limiting member so as to receive the first engaging member so that a tool extends through the recess between the body and the limiting member and is limited by the limiting member. The tool can only be taken away from the body by cutting the second engaging member extending through the first aperture in the body.

Applicant believes that another reference corresponds to U.S. Pat. No. 5,996,817 B1 issued to Kao on Dec. 7, 1999 for a tool suspension rack assembly. However, it differs from the present invention because Kao teaches a suspension rack is a rack having a base plate defining at least one hole, at least one suspension plate defining a slot, and at least one fastener member including an abutting plate abutting a first side of the suspension plate. A lug extends from the abutting plate and is received in the slot. A snapping member having a stub extends from the lug and is received in the hole. An enlarged cone-shaped head extends from the stub and abuts a second side of the base plate.

Applicant believes that another reference corresponds to U.S. Pat. No. 5,711,432 B1 issued to Stein, et al. on Jan. 27, 1998 for a pilfer-resistant peg hook assembly. However, it differs from the present invention because Stein, et al. teaches a pilfer-resistant peg hook assembly for supporting a plurality of articles incorporating defined slots and enabling only one article at a time to be removed therefrom is formed of a peg hook and a flipper. The peg hook has a pair of opposed ends and a body connecting the same. One of the hook ends is configured and dimensioned to maintain the hook body in a substantially horizontal first plane when mounted on an appropriate surface, and the other of the hook ends is a free end. The hook body is configured and dimensioned to be received in the slots of the articles and extends only in the first plane. The flipper is pivotably secured adjacent the free end and is movable between an enabling orientation enabling at least partial passage of an article along the hook body and onto the flipper as the article initially moves towards the free end, and a blocking orientation precluding passage of an article onto the flipper as the article moves towards the free end. The flipper is cammed into the blocking orientation as the article continues to pass over the flipper towards the free end.

Applicant believes that another reference corresponds to U.S. Pat. No. 5,624,040 B1 issued to Hono on Apr. 29, 1997 for a theft-preventive display hook system. However, it differs from the present invention because Hono teaches a security system for a display rack is provided in which merchandise in packages is threaded through an opening in the packaging over the free end of a hanger rod for display. The free end of the hanger rod is threaded, and a threaded cap is treated onto the free end of the rod to prevent removal of the package. The cap has a pair of opposed grooves, and a special key 13 is provided to remove the cap.

Applicant believes that another reference corresponds to U.S. Pat. No. 5,275,027 B1 issued to Eklof, et al. on Jan. 4, 1994 for a security device for merchandise display hooks. However, it differs from the present invention because Eklof, et al. teaches a security device is provided for use on pegboard type hooks. The device includes a housing with a lock mechanism, which releasably locks with the tines of a latch to securely grip the rod of the pegboard hook. A simple key-operated camming cylinder is manually operated to release the latch so that merchandise products carried on hook can be removed. The latch can be inserted into the housing and relocked on the hook without using the key.

Other patents describing the closest subject matter provide for a number of more or less complicated features that fail to solve the problem in an efficient and economical way. None of these patents suggest the novel features of the present invention.

SUMMARY OF THE INVENTION

The instant invention is a lock assembly for retail packaging having contents therein. More specifically, the instant invention is a magnetic lock assembly, comprising a lock assembly; a key assembly; and packaging comprising at least one wall. The lock assembly mounts exteriorly onto the packaging, and the lock assembly comprises an interior wall.

The instant invention also comprises a rail assembly. The rail assembly can mount onto a display rack. The rail assembly comprises rail members kept at a spaced apart relationship with respect to each other by a transversal member. The rail members have curvatures next to distal ends.

The instant invention also comprises a plate assembly comprising a plate and at least one hole. The at least one wall is positioned in between the lock assembly and the plate. The plate assembly mounts interiorly within the packaging.

The lock assembly comprises a pin assembly. The pin assembly comprises a shaft having an end and a pin head. The pin assembly or at least the end is of a ferromagnetic material. The pin head is sufficiently large in size to remain contained within the interior wall of the lock assembly. The interior wall comprises a sleeve and an aperture. The pin head rests upon the aperture when the lock assembly is in a locked position.

The instant invention also comprises locking means, whereby the lock assembly suspended from the rail members is placed in the locked position, whereby the pin assembly is blocked by the transversal member to prevent removal of the packaging from the rail assembly.

The key assembly is a magnet, and/or comprises a magnet. The key assembly is presented onto the lock assembly.

The instant invention also comprises unlocking means, whereby the key assembly comprising a predetermined magnetic force is presented onto the lock assembly to cause the pin assembly to shift from the locked position, to an unlocked position, whereby the transversal member does not block the pin assembly to permit removal of the packaging from the rail assembly.

The lock assembly comprises an exterior wall. Protruding from the exterior wall is at least one shaft having a shaft head that snaps though the at least one hole of the plate.

It is therefore one of the main objects of the present invention to provide a lock assembly that is permanently mounted onto a flap or wall section of retail packaging.

It is another object of the present invention to provide a lock assembly that prevents unauthorized individuals from removing retail packaging, with its respective lock assembly, from a rack or display.

It is another object of the present invention to provide a lock assembly that can be readily mounted and unmounted without tools.

It is another object of the present invention to provide a lock assembly that minimizes locking and unlocking time.

It is another object of the present invention to provide a lock assembly that is volumetrically efficient for carrying, transporting, and storage.

It is another object of the present invention to provide a lock assembly that is of a durable and reliable construction.

It is yet another object of the present invention to provide a lock assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
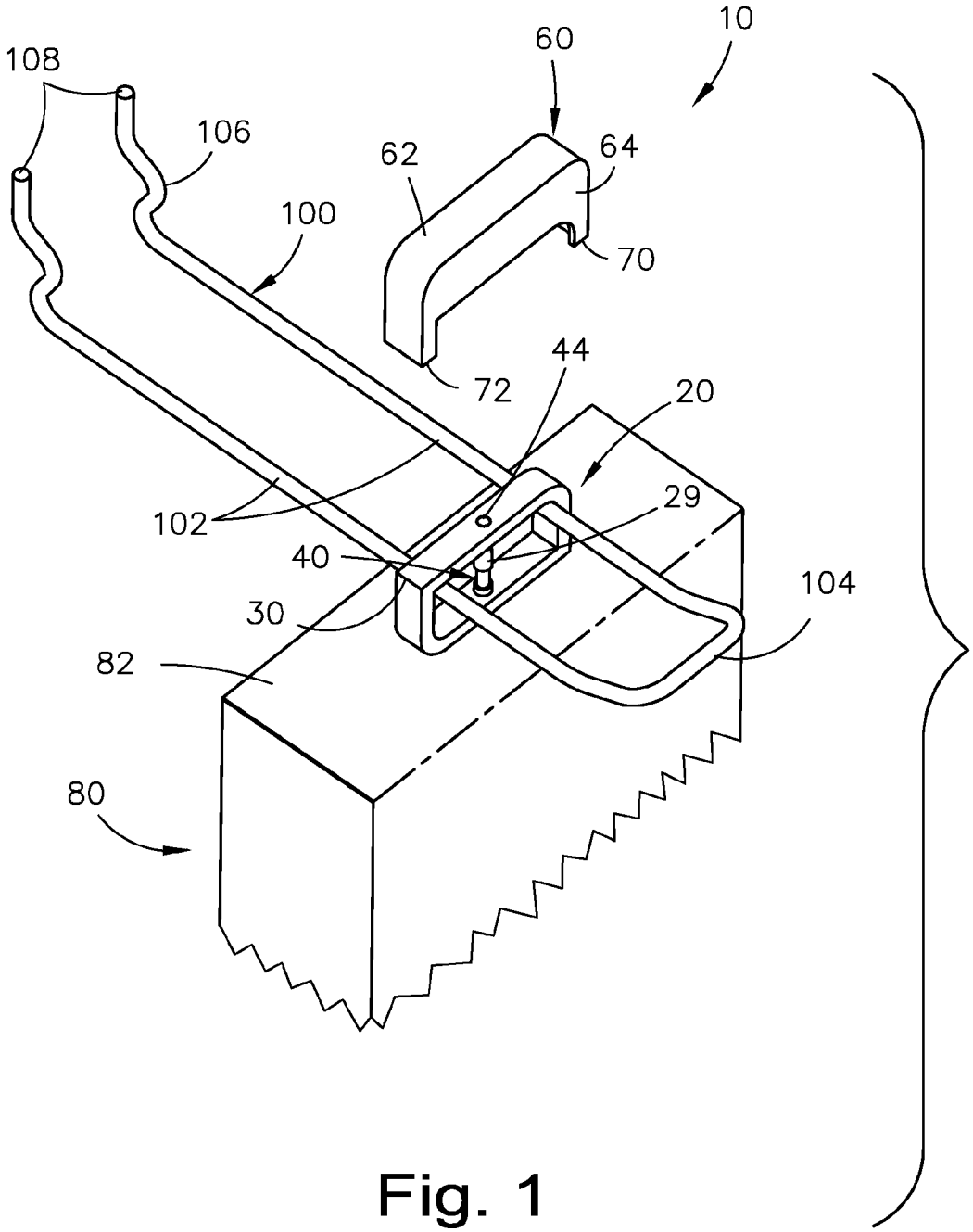
FIG. 1 is an isometric view of a lock assembly of the present invention in a locked position, mounted onto retail packaging while suspended from a rail assembly, and a key assembly.

Referring now to the drawings, the present invention is generally referred to with numeral 10. It can be observed that it basically includes lock assembly 20, key assembly 60, and rail assembly 100.

As seen in FIG. 1, present invention 10 comprises lock assembly 20, key assembly 60, and rail assembly 100. Lock assembly 20 mounts onto rail assembly 100, and key assembly 60 is used to unlock lock assembly 20 from rail assembly 100.

Rail assembly 100 includes rail members 102 kept at a parallel and spaced apart relationship with respect to each other by transversal member 104. Rail members 102 have curvatures 106 next to distal ends 108. A plurality of rail assemblies 100 are usually mounted to display racks in stores, not seen. Packaging 80, comprising products, not seen, typically suspend from rail members 102, and more specifically with instant invention 10, suspend by lock assembly 20 between curvatures 106 and transversal member 104.

As locking means, each lock assembly 20 suspended from rail members 102 is placed in a locked position, whereby pin assembly 40 is blocked by transversal member 104 to prevent removal of packaging 80 therefrom.

Figure 2A:
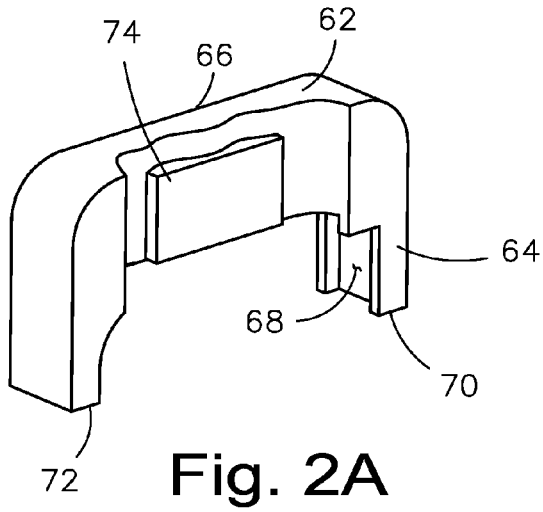
FIG. 2A is a partially cut view of the key assembly.
Figure 2B:
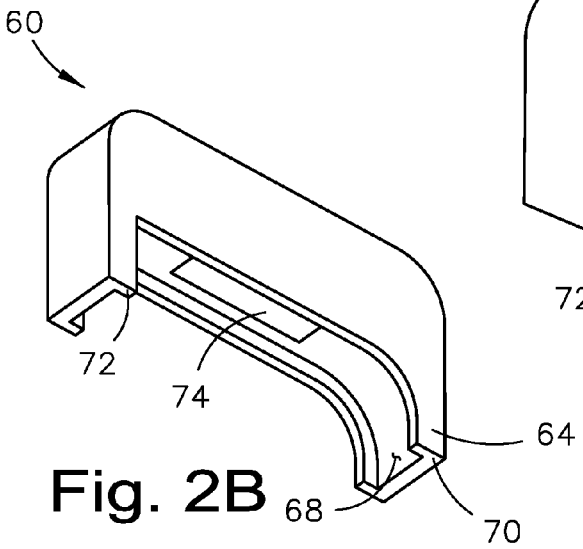
FIG. 2B is an isometric bottom view of the key assembly.

As seen in FIGS. 2A and 2B, key assembly 60 comprises exterior wall 62, and sidewalls 64 and 66. Cavity 68 is defined between ends 70 and 72. In a preferred embodiment, cavity 68 is shaped to cooperatively receive a section of exterior wall 22 when key assembly 60 is presented/mounted onto lock assembly 20. It is noted that cavity 68 has a curved section to complement the curvature of exterior wall 22 between the edges 30 and 32, seen in FIG. 3A. In a preferred embodiment, key assembly 60 is a magnet, or key assembly 60 comprises magnet 74.

Figure 3A:
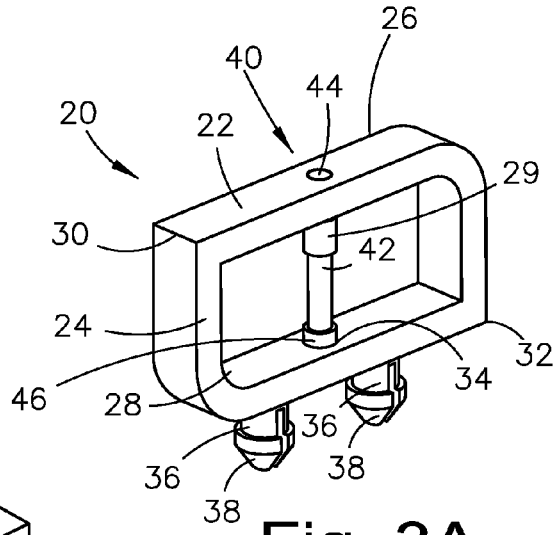
FIG. 3A is an isometric view of the lock assembly in the locked position.

As seen in FIG. 3A, lock assembly 20 comprises exterior wall 22, sidewalls 24 and 26, and interior wall 28. In a preferred embodiment, lock assembly 20 comprises a unique shape to define edges 30 and 32. It is noted that lock assembly 20 has a curved section between edges 30 and 32. Defined at interior wall 28 is aperture 34. Extending from interior wall 28 towards aperture 34, but without reaching aperture 34, is sleeve 29 having a distal end. Protruding from exterior wall 22 is at least one shaft 36 having shaft head 38. Lock assembly 20 mounts exteriorly onto packaging 80.

Lock assembly 20 comprises pin assembly 40. Pin assembly 40 comprises shaft 42 having end 44 and pin head 46. In a preferred embodiment, pin assembly 40, and at least end 44 is of a ferromagnetic material, such as iron. The ferromagnetism material is the basic mechanism by which certain materials form permanent magnets, or are attracted to magnets, such as magnet 74. Pin head 46 is sufficiently large in size to remain contained within interior wall 28 of lock assembly 20, and more specifically, is contained by sleeve 29. As seen in this illustration, lock assembly 20 is in the locked position, whereby pin head 46 is resting upon aperture 34. It is noted that in one embodiment, pin head 46 rests upon aperture 34 by gravity.

Figure 3B:
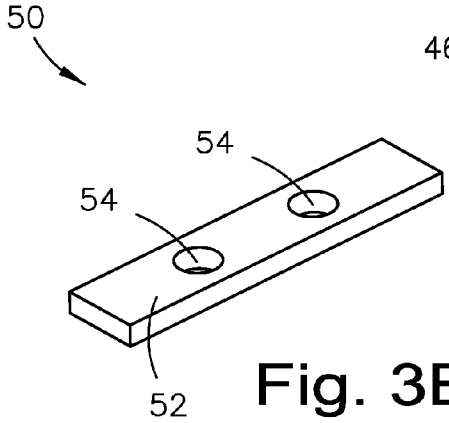
FIG. 3B is an isometric view of a plate assembly.

As seen in FIG. 3B, plate assembly 50 comprises plate 52 and at least one hole 54. In a preferred embodiment for stability and/or reinforcement, wall 82 of packaging 80, as seen in FIG. 1, is positioned in between lock assembly 20 and plate 52, whereby at least one hole 54 receives shaft head 38 therethrough to snap into place. Therefore, plate assembly 50 mounts interiorly within packaging 80 if necessary for stability and/or reinforcement. It is noted that plate assembly 50 is not required if wall 82 of packaging 80 is sufficiently strong. Although not illustrated, it is understood that wall 82 comprises a hole to accommodate shaft head 38 and shaft 36 therethrough.

Figure 4:
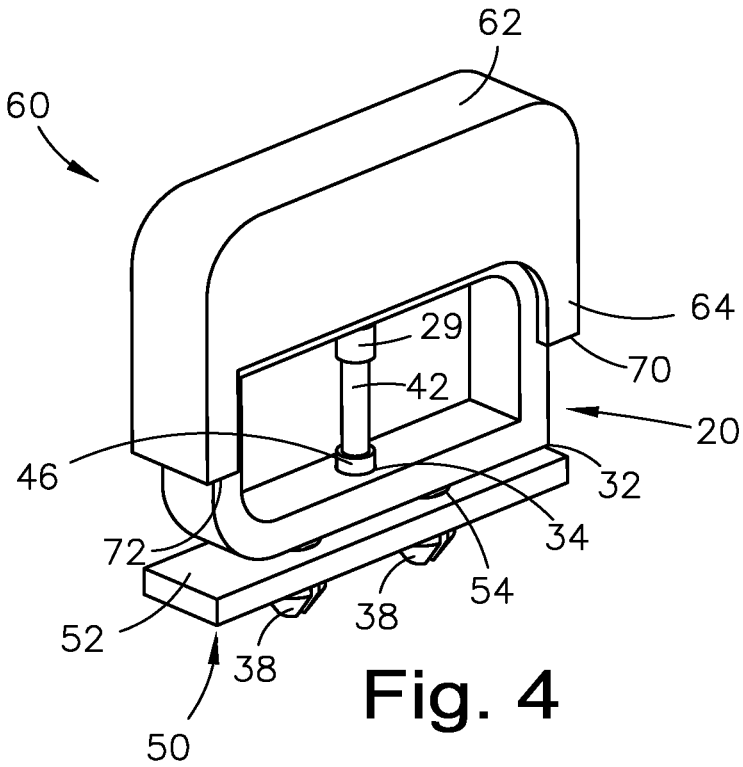
FIG. 4 is an isometric view of the lock assembly in the locked position with the key assembly presented thereon, and with the plate assembly.
Figure 5:
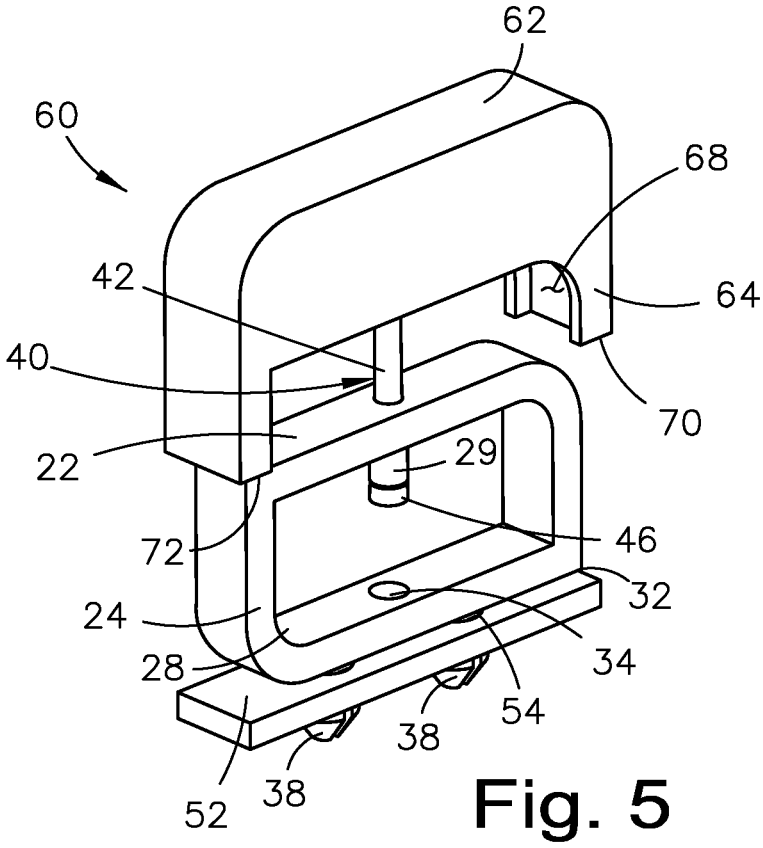
FIG. 5 is an isometric view of the lock assembly in the unlocked position with the key assembly elevated therefrom, and with the plate assembly.

As seen in FIG. 4, lock assembly 20 is in the locked position, whereby pin head 46 is resting upon aperture 34. For illustrative purposes, at least one hole 54 of plate 52 receives shaft head 38 therethrough to snap into place. Plate assembly 50 provides stability and/or reinforcement when lock assembly 20 is mounted onto wall 82 of packaging 80, seen in FIG. 1. As seen in this illustration, key assembly 60 is aligned and presented onto lock assembly 20. Key assembly 60 is utilized to place lock assembly 20 in the unlocked position, whereby cavity 68, seen in FIG. 5, is shaped to cooperatively receive a section of exterior wall 22 when presented/mounted thereon. It is noted that cavity 68 has a curved section to complement a curvature of exterior wall 22 between edges 30 and 32.

Figure 6:
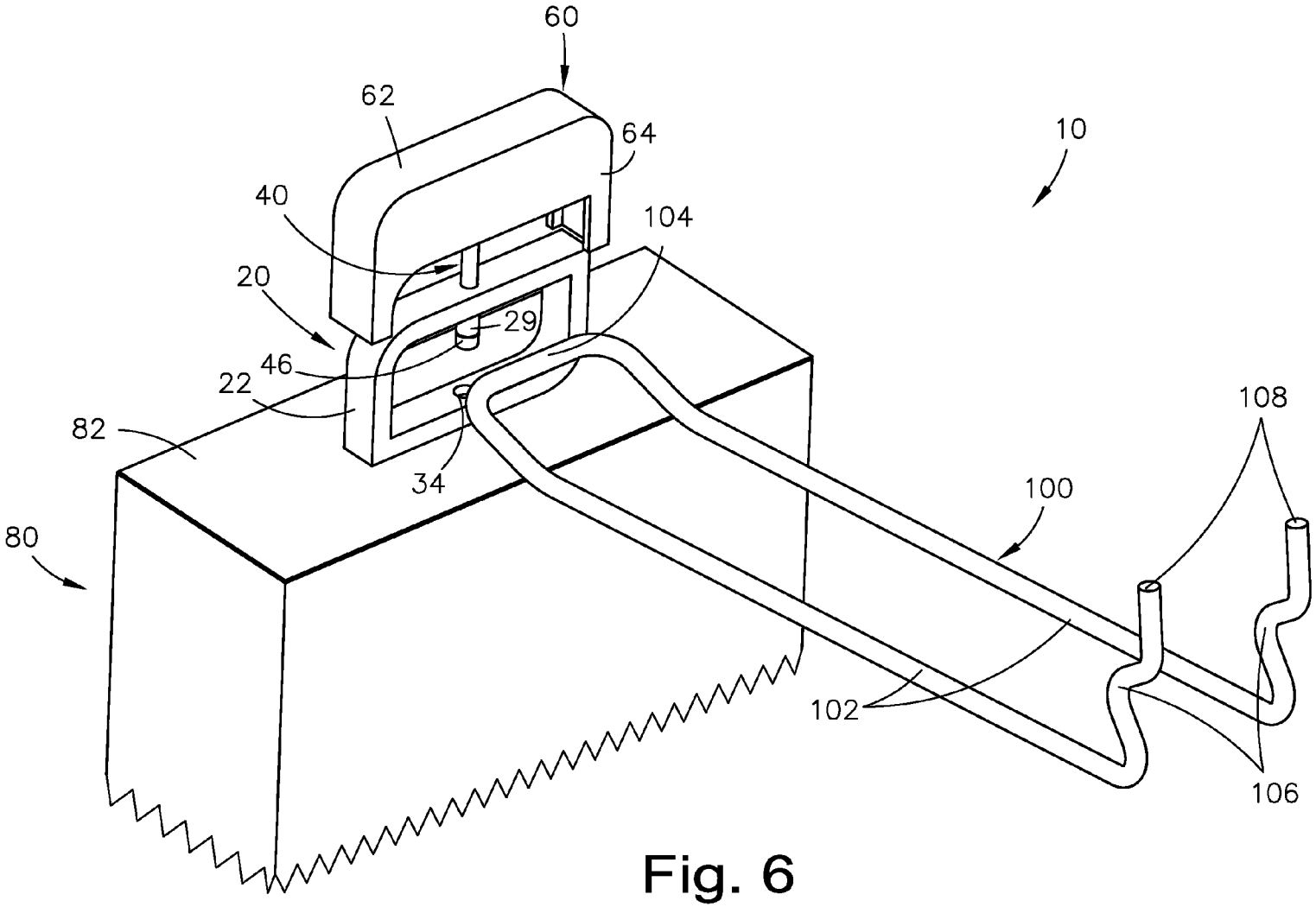
FIG. 6 is an isometric view of the lock assembly in the unlocked position with the key assembly elevated therefrom, mounted onto the retail packaging and being removed from the rail assembly.

As seen in FIGS. 5 and 6, magnet 74, seen in FIGS. 2A and 2B, has a predetermined magnetic force to cause pin assembly 40 to shift from the locked position seen in FIG. 4, to the unlocked position as illustrated.

As best seen in FIG. 6, in operation, distal ends 108 are inserted through holes of a look hoop system, not seen, and curvatures 106 hold them in place. Packaging 80, comprising products, not seen, typically suspend from rail members 102, and more specifically suspend between curvatures 106 and transversal member 104. As unlocking means, magnet 74 has a predetermined magnetic force to cause pin head 46 to shift from aperture 34, the locked position, towards sleeve 29, the unlocked position, to permit removal of packaging 80 from rail assembly 100.

In an alternate embodiment, rail assembly 100 may extend from a freestanding display rack, or other display assembly having an elongated rail assembly member from which packaging 80 may hang therefrom.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A magnetic lock assembly, comprising:

A) a lock assembly;

B) a key assembly;

C) packaging comprising at least one wall, said lock assembly mounts exteriorly onto said packaging; and D) a rail assembly.

2. The magnetic lock assembly set forth in claim 1, further characterized in that said rail assembly is mounted onto a display rack.

3. The magnetic lock assembly set forth in claim 1, further characterized in that said rail assembly comprises rail members kept at a spaced apart relationship with respect to each other by a transversal member.

4. The magnetic lock assembly set forth in claim 3, further characterized in that said rail members have curvatures next to distal ends.

5. The magnetic lock assembly set forth in claim 1, further comprising:

D) a plate assembly comprising a plate and at least one hole.

6. The magnetic lock assembly set forth in claim 5, further characterized in that said at least one wall is positioned in between said lock assembly and said plate.

7. The magnetic lock assembly set forth in claim 5, further characterized in that said plate assembly mounts interiorly within said packaging.

8. The magnetic lock assembly set forth in claim 3, further characterized in that said lock assembly comprises a pin assembly.

9. The magnetic lock assembly set forth in claim 8, further characterized in that said pin assembly comprises a shaft having an end and a pin head.

10. The magnetic lock assembly set forth in claim 9, further characterized in that said pin assembly or at least said end is of a ferromagnetic material.

11. The magnetic lock assembly set forth in claim 9, further characterized in that said lock assembly comprises an interior wall.

12. The magnetic lock assembly set forth in claim 11, further characterized in that said pin head is sufficiently large in size to remain contained within said interior wall of said lock assembly.

13. The magnetic lock assembly set forth in claim 11, further characterized in that said interior wall comprises an aperture.

14. The magnetic lock assembly set forth in claim 13, further characterized in that said pin head rests upon said aperture when said lock assembly is in a locked position.

15. The magnetic lock assembly set forth in claim 14, further comprising locking means, whereby said lock assembly suspended from said rail members is placed in said locked position, whereby said pin assembly is blocked by said transversal member to prevent removal of said packaging from said rail assembly.

16. The magnetic lock assembly set forth in claim 15, further characterized in that said key assembly is a magnet, and/or comprises a magnet.

17. The magnetic lock assembly set forth in claim 16, further characterized in that said key assembly is presented onto said lock assembly.

18. The magnetic lock assembly set forth in claim 17, further comprising unlocking means, whereby said key assembly comprising a predetermined magnetic force is presented onto said lock assembly to cause said pin assembly to shift from said locked position, to an unlocked position, whereby said transversal member does not block said pin assembly to permit removal of said packaging from said rail assembly.

19. The magnetic lock assembly set forth in claim 5, further characterized in that said lock assembly comprises an exterior wall, protruding from said exterior wall is at least one shaft having a shaft head that snaps though said at least one hole of said plate.

* * * * *